US005771423A

United States Patent [19]

Hama

[11] Patent Number: 5,771,423

[45] Date of Patent: Jun. 23, 1998

[54] IMAGE FORMING APPARATUS

[75] Inventor: Junichi Hama, Kanagawa, Japan

[73] Assignee: Fuji Xerox Co., Ltd., Tokyo, Japan

[21] Appl. No.: 697,254

[22] Filed: Aug. 21, 1996

Related U.S. Application Data

[63] Continuation of Ser. No. 404,769, Mar. 15, 1995, abandoned.

[30] Foreign Application Priority Data

Mar. 30, 1994 [JP] Japan ..... 6-060896

[51] Int. Cl.[6] ..... G03G 15/08

[52] U.S. Cl. ..... 399/55; 399/235

[58] Field of Search ..... 399/55, 53, 285, 399/237, 235, 121; 430/100, 103

[56] References Cited

U.S. PATENT DOCUMENTS 4,797,335 1/1989 Hiratsuka et al. ..... 355/265 X 5,418,097 5/1995 Furuya et al. ..... 355/246

FOREIGN PATENT DOCUMENTS 62-151875 7/1987 Japan .
2-235079 9/1990 Japan .
4-63375 2/1992 Japan .
6-118772 4/1994 Japan .
6-222676 8/1994 Japan .

*Primary Examiner*—Arthur T. Grimley
*Assistant Examiner*—Quana Grainger
*Attorney, Agent, or Firm*—Finnegan, Henderson, Farabow, Garrett & Dunner, L.L.P.

[57] ABSTRACT

A voltage application timing control unit is connected to a DC component applying unit and an AC component applying unit in a developing bias applying unit. The voltage application timing control unit independently controls the DC component applying unit and the AC component applying unit so as to independently control the timing of applying a DC voltage from the DC component applying unit to the related member and the timing of applying an AC voltage from the AC component applying unit to the same.

4 Claims, 4 Drawing Sheets

IMAGE FORMING APPARATUS

This application is a continuation of application Ser. No. 08/404,769, filed Mar. 15, 1995, now abandoned.

BACKGROUND OF THE INVENTION

The present invention relates to an image forming apparatus of the xerography type which includes a developing unit for visualizing a latent electrostatic image on a photoreceptor by using a two-component developer consisting of magnetic carriers and nonmagnetic toner. More particularly, the invention relates to an image forming apparatus in which the developing unit applies a developing voltage formed by superposing an AC voltage on a DC voltage, thereby developing a latent electrostatic image into a visual image.

A xerography basis image forming process has widely been employed in image forming apparatuses, such as printers and copying machines.

In the xerography basis image forming apparatus, a photoreceptor in the form of a drum is uniformly charged, a latent electrostatic image is formed on the photoreceptor by an exposure process, the latent electrostatic image is developed, the developed image is transferred onto a transfer member, and is fixed thereon.

In this way, the image forming apparatus forms a visual image on the transfer member through a sequence of image forming processes.

A magnetic brush developing unit using a two-component developer consisting of magnetic carriers and nonmagnetic toner is well known for the developing unit which develops a latent electrostatic image formed on the photoreceptor into a visual image. In many recent proposals, for example, Published Unexamined Japanese Patent Application No. Hei. 4-63375, a voltage formed by superposing an AC voltage on a DC voltage is used for a bias voltage in order to improve picture quality.

An example of a conventional image forming apparatus with such a developing unit will briefly be described.

As shown in FIG. 4, a conventional image forming apparatus 1 is made up of a photoreceptor 2 in the form of a drum, made of organic photoconductive material (OPC), which is a latent image bearing means bearing a latent electrostatic image corresponding to an image read by an image reader, not shown, a ROS unit 3 having a laser device, a polygonal mirror, and the like, which emits a laser beam modulated by an image signal outputted from the image reader, a corona charger 4 for uniformly charging the photoreceptor drum 2 negatively in polarity (e.g., −650 V), and a developing unit 5, located adjacent to the photoreceptor drum 2, which contains a two-component developer consisting of negatively charged toner and magnetic carriers, and develops a latent image on the photoreceptor drum 2 into a visual image, using the toner of the developer.

In the image forming apparatus 1 thus constructed, the photoreceptor drum 2 is uniformly charged negatively in polarity by the corona charger 4, and is exposed to a laser beam emitted from the ROS unit 3, so that a latent electrostatic image is formed on the drum.

Within the developing unit 5, the two-component developer is transported to a developing roller 7 with a magnet contained therein while being agitated by an agitator member 6. The developer reaches the developing roller 7, and the crests of the developer are aligned at a desired height on the developing roller 7 by a partition plate 8 located in proximity to the developing roller 7 with a preset gap therebetween.

Subsequently, with rotation of the developing roller 7, the developer whose crests are aligned is transported from the developing roller 7 to a developing region facing the photoreceptor drum 2.

A developing bias voltage is applied to the developing roller 7 by a developing bias applying means 9. The developing bias voltage is formed by superposing an AC voltage of an AC component derived from an AC component applying means 11, on a DC voltage of a DC component from a DC component applying means 10. The DC component and the AC component are simultaneously applied to the developing roller 7. The toner of the developer transported to the developing region facing the photoreceptor drum 2, sticks to only the portions on the developing roller 7 where are exposed to the laser beam. As a result, a latent electrostatic image on the developing roller 7 is developed into a visual image.

The timing of applying the developing bias voltage to the developing roller in the developing unit of the conventional image forming apparatus will be described.

To transfer an image on a transfer paper, as shown in FIG. 5, at time point t1 a print start button is depressed, so that the main motor starts to rotate and then the photoreceptor drum 2 turns. Then, the corona charger 4 starts to discharge to uniformly charge the photoreceptor drum 2. At a time point t2 prior to a time point t3 at which the leading edge of the uniformly charged photoreceptor drum 2 passes the developing position, the developing bias voltage containing the superposed DC and AC components is applied to the developing roller 7. At a time point t4 where a preset time has elapsed after the uniform charging of the photoreceptor drum 2 starts, an exposure process of the photoreceptor drum 2 by the laser beam starts. Through this exposure process, image is written into the surface of the photoreceptor drum 2, thereby forming a latent electrostatic image thereon. Under the bias voltage containing the DC and AC components, the latent electrostatic image in the image area on the photoreceptor drum is developed into a visual image.

To stop the image forming operation, the exposure process by the laser beam is stopped at a time point t5, and the uniform charging of the photoreceptor drum 2 by the corona charger 4 is stopped at a time point t6. Thereafter, at a time point t7 the application of the developing bias containing the DC and AC components is stopped, while at the same time the rotation of the photoreceptor drum 2 is stopped.

In the xerographic developing process as described above, an electric field is shaped such that within the developing region, the toner is moved to the image area on the photoreceptor drum 2, and the carriers are moved to the non-image area.

At the start and the end of the image forming operation, it is impossible to simultaneously control the rise and the fall of the developing bias voltage in the charge and/or exposure process and the developing process. In a general measure taken for this, to prevent the carriers of the developer from moving toward the photoreceptor drum, the developing bias voltage is made to rise at such a timing as to develop a developing electric field below a given electric field corresponding to that in the non-image area. In the case of the inversion development in which the toner used for the development has the same polarity as that of the photoreceptor drum 2, as seen from FIG. 5, the developing bias voltage is made to rise earlier than the charge and/or exposure process, and the developing bias voltage is made to fall after the charge and/or exposure process.

In the case of the normal development in which the polarity of the toner is different from that of the photoreceptor drum 2, the developing bias voltage is made to rise after the charge and/or exposure process, and the developing bias voltage is made to fall earlier than the charge and/or exposure process.

In connection with the conventional method of setting up the timings of the bias voltage application, particularly in the case of using the developing bias consisting of the superposed AC and DC components in the inversion development, a large developing electric field, in excess of that during a normal image forming operation (development), is temporarily developed. Under this large developing electric field, the carriers tend to move with the moving toner at the start and the end of the image forming operation. These carriers are scattered within the machine, to thereby damage the photoreceptor and/or deteriorate the picture quality. This problem is more distinguished particularly in the carriers of small particle size, frequently used for improvement of the picture quality in recent machines.

SUMMARY OF THE INVENTION

For the above background reasons, an object of the present invention is to provide an image forming apparatus which reliably prevents the carriers from moving toward the photoreceptor at the start and the end of the image forming operation, viz., surely prevents the leakage of the carriers.

To achieve the above object, claim 1 sets forth an image forming apparatus in which by a developing voltage formed by superposing an AC voltage on a DC voltage and applied from a developing voltage applying means, only nonmagnetic toner of two-component developer consisting of magnetic carriers and nonmagnetic toner is moved to a photoreceptor, thereby developing a latent electrostatic image formed on the photoreceptor into a visual image, the image forming apparatus being improved in that the image forming apparatus includes a voltage application timing control means for independently controlling the timings of applying the DC voltage and the AC voltage.

Claim 2 sets forth the image forming apparatus of claim 1, constructed such that when a given image forming process starts, the voltage application timing control means applies the DC voltage and then applies the AC voltage.

Claim 3 sets forth the image forming apparatus of claim 1 or 2, constructed such that when a given image forming process ends, the voltage application timing control means stops the operation of applying the AC voltage and then stops the operation of applying the DC voltage or stops both the applying operation of the AC voltage and the DC voltage simultaneously.

In the image forming apparatus thus constructed, the voltage application timing control means controls the DC component and the AC component of the developing voltage at different timings. By the independent controls, an extremely large electric field is not developed at the time of image formation, thereby preventing the carriers from moving toward the photoreceptor, viz., the carrier leakage. Particularly in the invention set forth in claim 2, at the start of the image forming operation, only the DC component of the developing voltage is made to rise, and then only the AC component is superposed on the DC component. In the invention set forth in claim 3, at the end of the image forming operation, only the AC component is made to fall, and then the DC component is made to fall.

Thus, at the start and the end of the image forming operation, a considerably large developing electric field is not formed. Therefore, the image forming apparatus of the invention can reliably prevent the carriers from moving toward the photoreceptor, viz., leakage of the carriers.

Accordingly, the image forming apparatus of the invention succeeds in solving the problems of dispersion of the leaked carriers into the space within the machine, the damage of the photoreceptor by the leaked carriers, and the deterioration of the resultant picture.

DETAILED DESCRIPTION OF THE PREFERRED EMBODIMENTS

The preferred embodiment of the present invention will be described with reference to the accompanying drawings.

Figure 1:
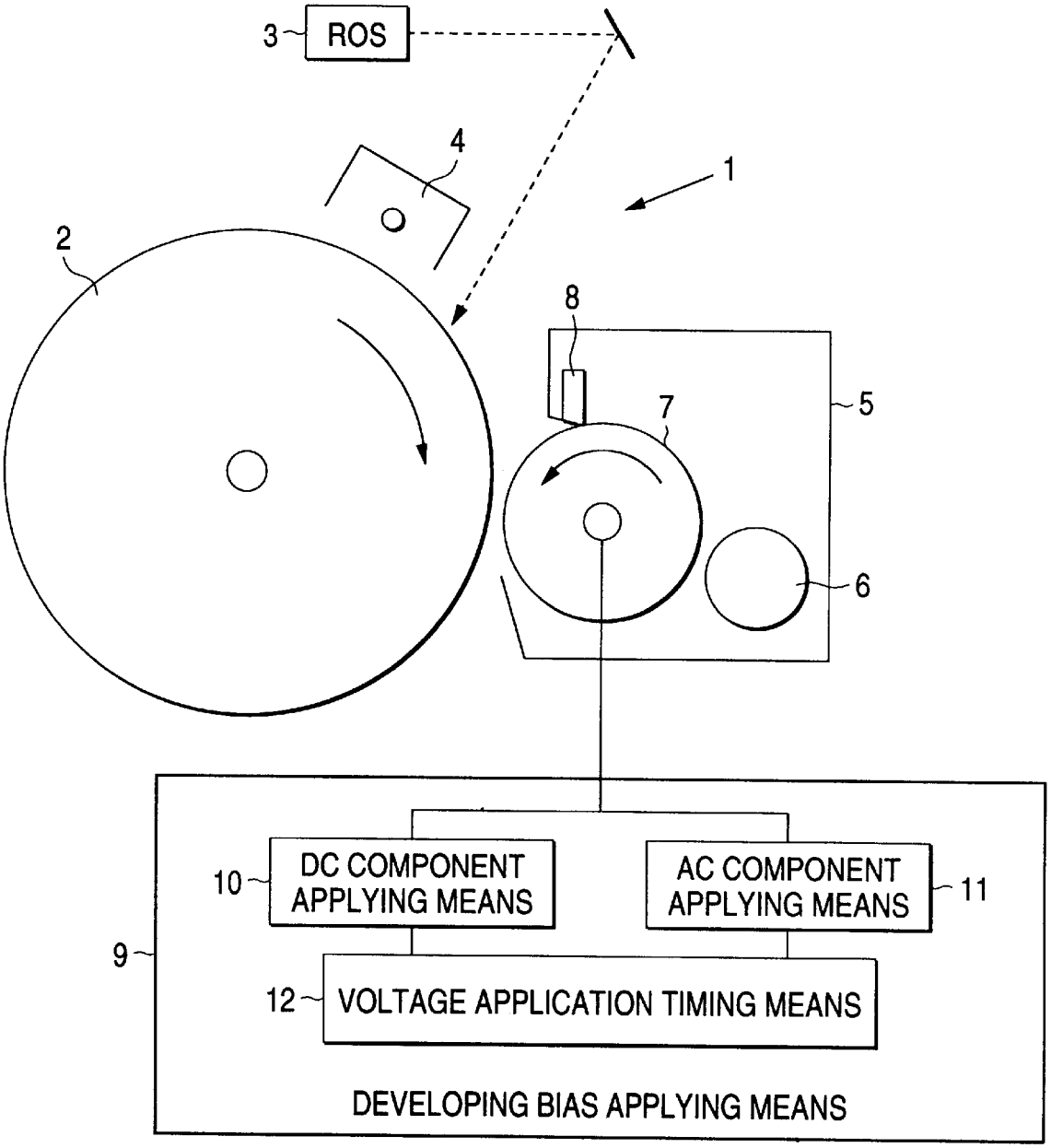
FIG. 1 is a diagram partially and schematically showing an embodiment of an image forming apparatus according to the present invention.
Figure 4:
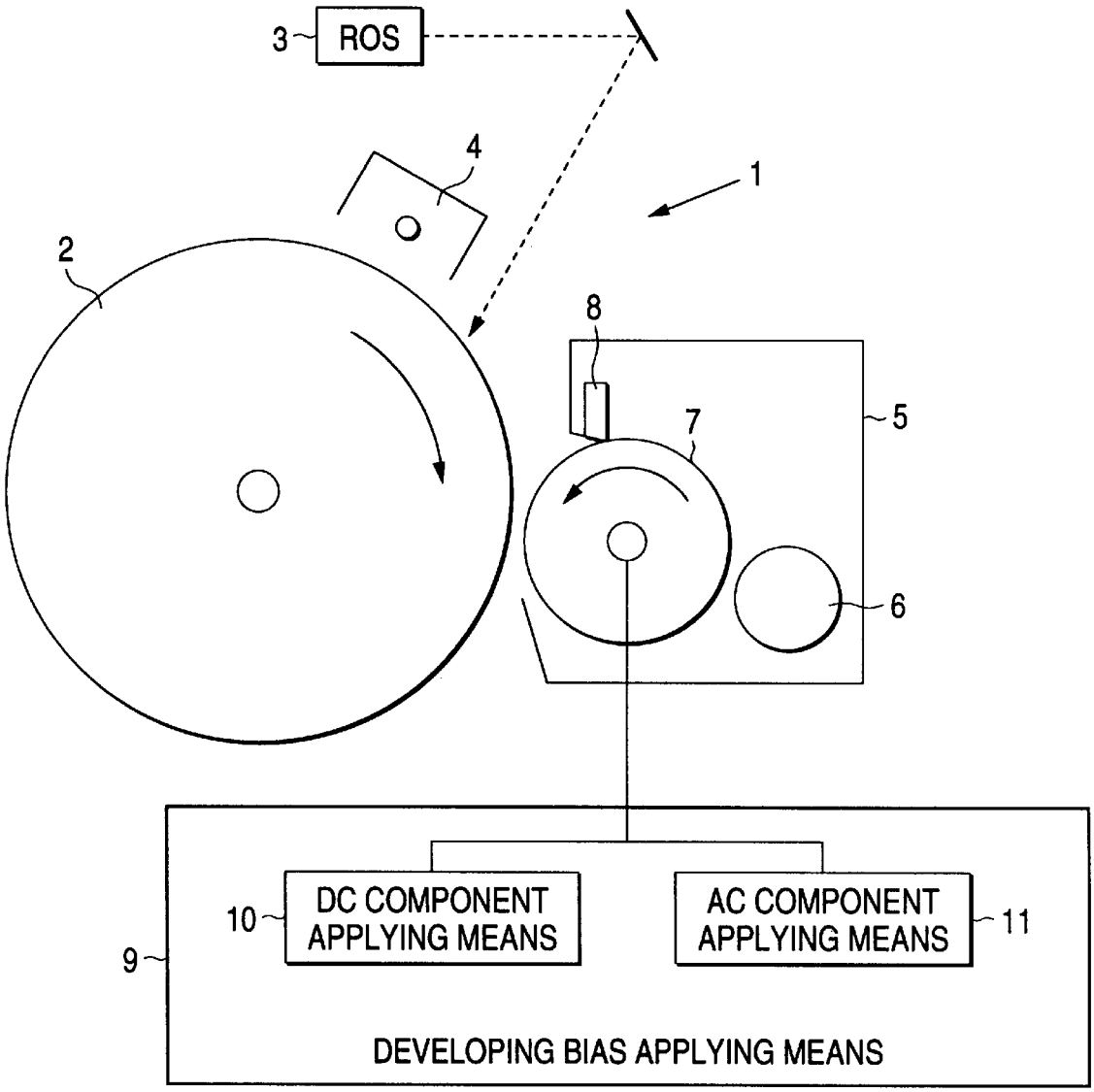
FIG. 4 PRIOR ART
FIG. 4 is a diagram partially and schematically showing a conventional image forming apparatus.

FIG. 1 is a diagram showing a portion of an embodiment of an image forming apparatus according to the present invention. In the figure, like or equivalent portions are designated by like reference numerals in FIG. 4 showing the conventional image forming apparatus.

As shown in FIG. 1, in an image forming apparatus 1 of the invention, a voltage application timing control means 12 is connected to a DC component applying means 10 and an AC component applying means 11 in a developing bias applying means 9. The voltage application timing control means 12 independently controls the DC component applying means 10 and the AC component applying means 11 so as to independently control the timing of applying a DC voltage (e.g., DC: −500V) from the DC component applying means 10 to the related member and the timing of applying an AC voltage (e.g., AC: 2 kHz/1500 Vp-p) from the AC component applying means 11 to the same.

Next, the timings of applying the developing bias voltage in the present embodiment will be described.

Figure 2:
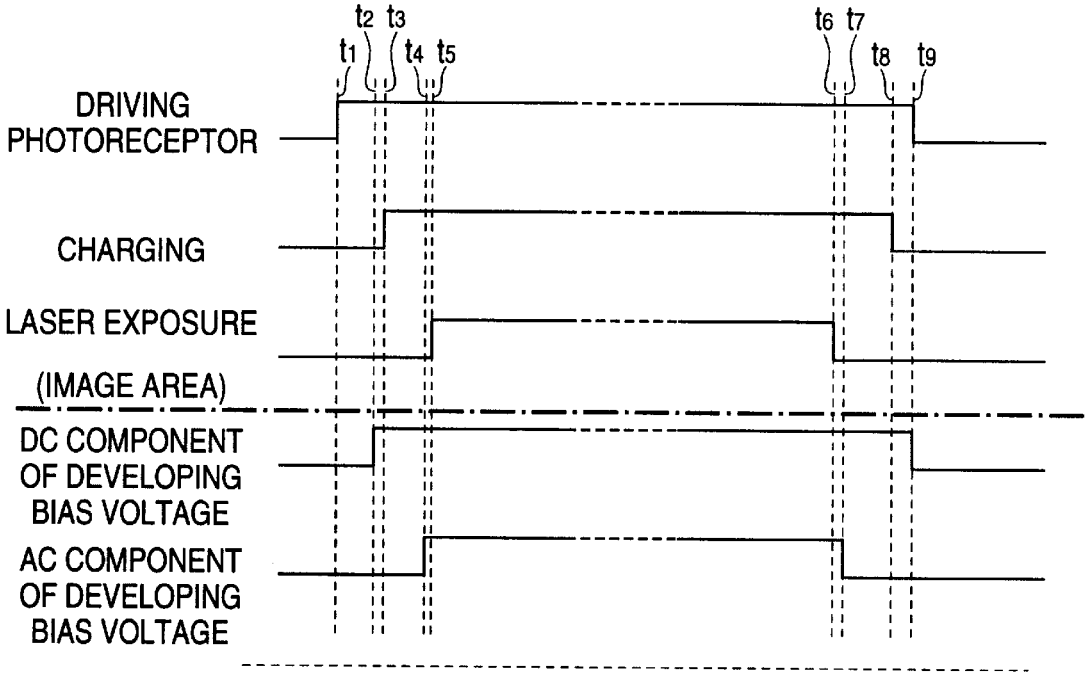
FIG. 2 is a timing chart showing the application of a developing bias voltage in the embodiment of FIG. 1.
Figure 3:
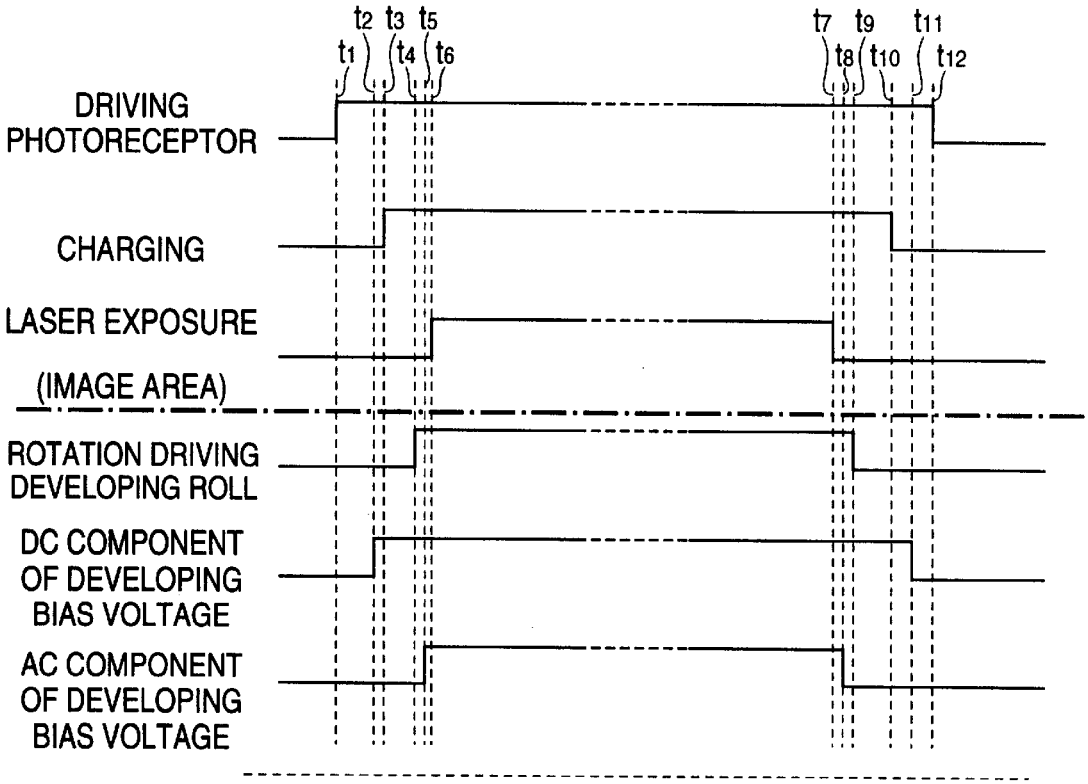
FIG. 3 is another timing chart showing the application of a developing bias voltage in the embodiment of FIG. 1.
Figure 5:
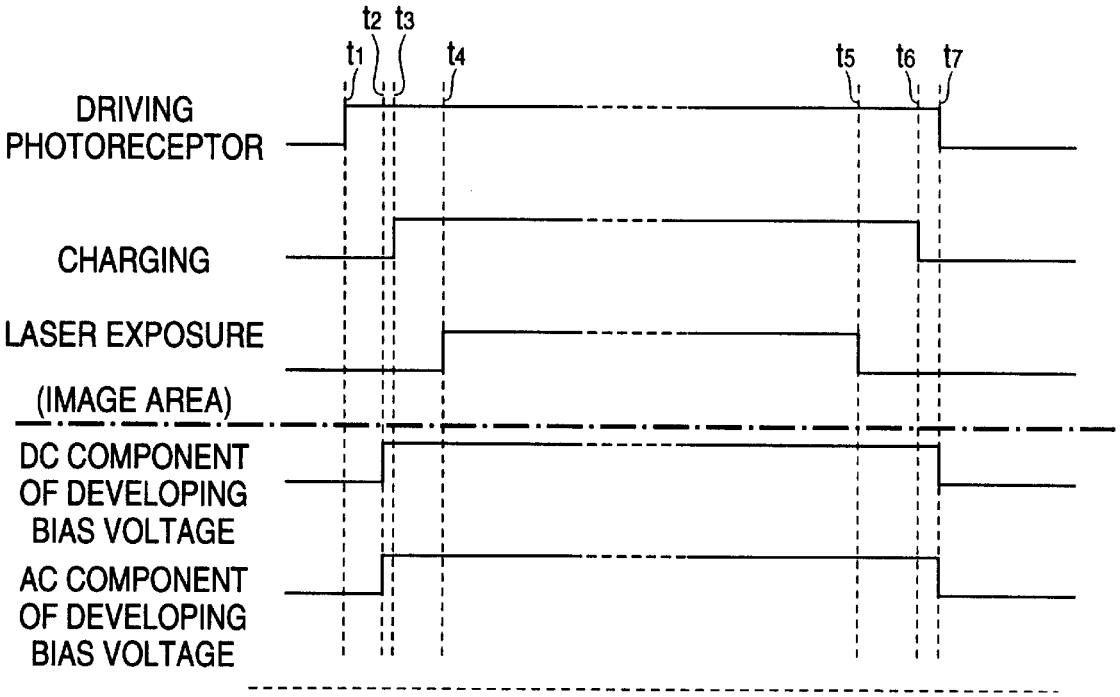
FIG. 5 PRIOR ART
FIG. 5 is a timing chart showing a conventional application of a developing bias voltage.

FIGS. 2, 3, and 5 show processing flows in the control unit 12.

FIG. 2 shows a timing-chart of controlling an apparatus by the present invention. In FIG. 2, the timing charts above the dashed line show a controlling timing for turning on each controlling device, and each timing chart below the dashed line shows a timing in a developing area. These are related at a position on a photoreceptor with each other. Namely, in FIG. 2, at first, while a photoreceptor is driven, charged, and exposed by laser beam, a DC device is turned on at a timing immediately before a leading portion of a charged area of the photoreceptor reaches a developing position, and next an AC device is turned on at a timing immediately before an exposed portion on the photoreceptor reaches the developing position. On the contrary, while the laser exposure is turned off and charging is turned off, and the driving of the photoreceptor is turned off upon finishing forming an image, the AC device is turned off immediately after a following portion of the area exposed by laser beam passes the developing position, and the DC device is turned off immediately after a following portion of the charged area on the photoreceptor passes the developing position.

In FIG. 3, moreover, a rotating driving of a developing roll at a developing position is also shown. Besides, in FIG.

5, a conventional art is similarly shown, and an AC device and a DC device of the developing apparatus are turned on immediately before a leading portion of the charged area reaches a developing position. In this embodiment, since a high developing bias voltage is applied to a leading portion of the background area (which is charged, and is not exposed), a problem occurs since the carriers charged, contrary to a polarized direction of the toner, attach to this area. In the present invention, since no AC voltage is applied to a leading portion and to a following portion of the background area, it is possible to reduce carry over to this area. As controlling, it may be possible to reverse the applying order of DC voltage to AC voltage. However, since an AC voltage is an alternating electric field, a fog (the toner particles attach to the background area) may be generated according to a voltage situation of the surface of the photoreceptor. It is possible to obtain a higher effect in case of applying only a DC voltage, since both the toners and the carriers are prevented from being transferred. Therefore, as in this embodiment, it is best to start the voltage application in the order of DC voltage to AC voltage and to stop the voltage in the order of AC voltage to DC voltage.

To perform an image operation onto a transfer paper, as shown in FIG. 2, at a time point t1 a print start button is depressed, a main motor starts to turn, and then the photoreceptor drum 2 turns. Then, the corona charger 4 starts to discharge to uniformly charge the photoreceptor drum 2. At a time point t2 prior to a time point t3 at which the leading edge of the uniformly charged photoreceptor drum 2 passes the developing position, the voltage application timing control means 12 controls the AC component applying means 11 to apply only the DC component to the developing roller 7. After a preset time elapses from the start of the uniform charging of the photoreceptor drum 2, an exposure process of the photoreceptor drum 2 by the laser beam starts. Through the exposure process, image is written into the surface of the photoreceptor drum 2, thereby forming a latent electrostatic image thereon. At a time point t4 prior to a time point t5 where the leading edge of the latent image area passes the developing position, the voltage application timing control means 12 controls the AC component applying means 11 to superpose the AC component on the DC component applied in advance. Under the bias voltage containing the superposed DC and AC components, the latent electrostatic image in the image area on the photoreceptor drum is developed into a visual image.

As described above, in the present invention, the DC component of the developing voltage is applied to the developing roller 7 before the AC component is applied thereto. Accordingly, when only the DC component is applied to the developing roller before the uniform charged area on the photoreceptor drum 2 is reached, an intensive electric field is not generated while it is generated in the conventional developing unit in which the DC component and the AC component are simultaneously applied at this time. As a result, only the toner is moved to the photoreceptor drum 2. The problem of the movement of the carriers to the photoreceptor drum 2, viz., the carrier leakage, is solved. Additionally, it is noted that the application of the DC component of the bias voltage is carried out outside the image forming area. After the transfer process, little toner sticks to the transfer paper.

To stop the image forming operation, the laser beam exposure ends at a time point t6, the final image on the photoreceptor drum 2 passes the developing position, and before the developing roller 7 stops its rotation, at a time point t7 the voltage application timing control means 12 controls the operation of the AC component applying means 11 to stop only the application of the AC component of the developing bias voltage. Thereafter, at a time point t8 the operation of uniformly charging the photoreceptor drum 2 by the corona charger 4 terminates. After the trailing edge of the uniformly charged area on the photoreceptor drum 2 passes the developing position, at a time point t9, the voltage application timing control means 12 controls the operation of the DC component applying means 10 to stop the application of the DC component of the developing bias voltage, and the rotation of the photoreceptor drum 2 stops.

As described above, in the present embodiment, the procedural operations of the respective portions for stopping the image forming operation is reverse to those for starting the image forming operation.

FIG. 3 is a timing chart showing the application of a developing bias voltage in another embodiment of the present invention.

As shown in FIG. 3, the operation of the image forming apparatus from the print start at a time point t1 to the operation of uniformly charging the photoreceptor drum 2 at the time point t3 is the same as that in the first embodiment. After a preset time elapses from the start of uniformly charging the photoreceptor drum 2, the exposure of the photoreceptor drum 2 to the laser beam starts to write an image on the photoreceptor drum 2 and to form a latent electrostatic image thereon. The rotation of the developing roller 7 starts at a time point t4 prior to a time point t6 where the leading edge of the image area passes the image position. When an area of an image, not a print image, for the control, for example, is present ahead of the leading edge of the image area, the developing roller 7 is driven for rotation, as a matter of course.

After the rotation of the developing roller 7 starts, but before the leading edge of the image area passes the present position, at a time point t5 the AC component of the developing bias voltage is superposed on the previously applied DC component by the voltage application timing control means 12, and the superposed AC and DC components are applied to the developing roller 7. Under the developing bias voltage consisting of the superposed AC and DC voltages, the latent electrostatic image is visualized in the image area.

To stop the image forming operation, the laser beam exposure ends at a time point t7, the final image on the photoreceptor drum 2 passes the developing position, and before the developing roller 7 stops its rotation, only the application of the AC component of the developing bias voltage is stopped at a time point t7. Thereafter, at a time point t9 the rotation of the developing roller 7 stops, and thereafter the operation of uniformly charging the photoreceptor drum 2 by the corona charger 4 stops at a time point t10. After the trailing edge of the uniformly charged area on the photoreceptor drum 2 passes the developing position, at a time point t11, the application of the DC component of the developing bias voltage is stopped, and thereafter at a time point t12 the drive of the photoreceptor drum 2 stops.

As described above, in the present invention, at the timings of ON and OFF of the AC component of the developing bias voltage, the developing roller 7 turns. Accordingly, a time period where the developer is under the developing electric field within the developing area is short. Accordingly, the second embodiment can more easily attain the useful effects than the first embodiment.

The above-mentioned embodiments are each arranged such that at the end of the image forming operation, the application of the AC voltage stops, and then the application of the DC voltage stops. Alternatively, the application of the DC voltage may be stopped simultaneously with the stop of the application of the AC voltage.

As seen from the foregoing description, in the present invention, the AC component and the DC component of the developing bias voltage are applied to the developing roller at different timings. Accordingly, when the developing bias voltage is applied, a developing electric field in excess of the developing electric field developed in a normal state will not be developed.

Therefore, the image forming apparatus of the invention can reliably prevent the carriers from moving toward the photoreceptor, viz., surely prevent the leakage of the carriers. Thus, the image forming apparatus of the invention can reliably prevents the dispersion of the leaked carriers into the space within the machine, the damage of the photoreceptor by the leaked carriers, and the deterioration of the resultant picture.

What is claimed is:

1. An image forming apparatus in which, under a developing voltage consisting of an AC voltage and a DC voltage that is applied from a developing voltage applying means, only nonmagnetic toner of two-component developer comprising magnetic carriers and nonmagnetic toner is moved to a photoreceptor, thereby developing a latent electrostatic image formed on said photoreceptor into a visual image, the apparatus comprising:

a voltage application timing control means for independently controlling the timings of applying said DC voltage and said AC voltage to a developing element of the apparatus; and wherein when a given image forming operation starts, said voltage application timing control means applies said DC voltage and then applies said AC voltage, and wherein when a given image forming operation ends, said voltage application timing control means stops both the operations of applying said AC voltage and said DC voltage simultaneously.

2. The image forming apparatus according to claim 1, wherein:

said voltage application timing control means turns the AC voltage ON before the development of the latent electrostatic image begins and OFF after the development of the latent electrostatic image is completed.

3. The image forming apparatus according to claim 1, wherein said DC voltage is −500V.

4. The image forming apparatus according to claim 1, wherein said AC voltage is 2 kHz/1500$V_{p\text{-}p}$.

* * * * *